US006377660B1

(12) United States Patent
Ukita et al.

(10) Patent No.: US 6,377,660 B1
(45) Date of Patent: Apr. 23, 2002

(54) X-RAY GENERATOR

(75) Inventors: Masaaki Ukita, Kyoto; Yoshikazu Yoshida, Kyotanabe, both of (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 09/583,918

(22) Filed: May 31, 2000

(30) Foreign Application Priority Data

Jul. 22, 1999 (JP) ..... 11-207163

(51) Int. Cl.[7] ..... H01J 35/08
(52) U.S. Cl. ..... 378/143; 378/124; 378/126
(58) Field of Search ..... 378/124, 126, 378/143

(56) References Cited

U.S. PATENT DOCUMENTS 3,753,020 A * 8/1973 Zingaro ..... 378/124
5,010,562 A * 4/1991 Hernandez et al. ..... 378/124
5,148,462 A * 9/1992 Spitsyn et al. ..... 378/124
5,857,008 A * 1/1999 Reinhold ..... 378/126

* cited by examiner

*Primary Examiner*—Craig E. Church
(74) *Attorney, Agent, or Firm*—Rader, Fishman & Grauer, PLLC

(57) ABSTRACT

One or more metal targets are formed on a base member patterning technique such as a masking process. The metal targets may be irradiated by an electron beam to generate X-rays.

23 Claims, 5 Drawing Sheets

X-RAY GENERATOR

BACKGROUND OF THE INVENTION

1. Field of the Invention

This invention is related to an X-ray generator and X-ray generation. For example, the X-ray generator may be used for nondestructive testing for inspecting am aluminum castings (an integrated circuit), and so on for X-ray analysis, with an industrial X-ray apparatus for obtaining an X-ray picture of a cell, and so on.

2. Description of the Related Art

An X-ray generator has a tube body 01 the inside of which is kept in a vacuum state, as shown in FIG. 9. The body 01 has an electron source 02 and a target member 03 therein. The target member 03 has a base member 05, made of Aluminum, for example, on which a metal target 04 of Tungsten, for example, is evaporated. The base member 05 is attached to the body 01.

The body 01 has an electrode 06 for pulling an electron beam out of the electron source 02 and an electron lens 07. The electrode pulls out electrons as an electron beam from the electron source 02 and the lens 07 converges the beam. The converged electron beam is irradiated onto the metal target 04 and then the metal target 04 generates X-rays.

When it is necessary to make the focal point smaller to inspect an microscopic object, a small X-ray focal point on the large metal target 04 is created by converging an electron beam at a much smaller point with the electron lens 07. In the above structure, it is impossible to make an X-ray focal point smaller than a certain size because electrons with negative charge in the X-ray beam repel one another. It is also necessary to cool the electron lens 07 which generates heat in use. Therefore, the X-ray generator becomes large because of the need for a cooling system for the electron lens 07.

SUMMARY OF THE INVENTION

It is therefore an object of this invention to provide a low-cost and small X-ray generator which has a small X-ray focal point.

DESCRIPTION OF THE PREFERRED EMBODIMENTS

The following is a detailed description of examples an X-ray generators according to the present invention.

Figure 1:
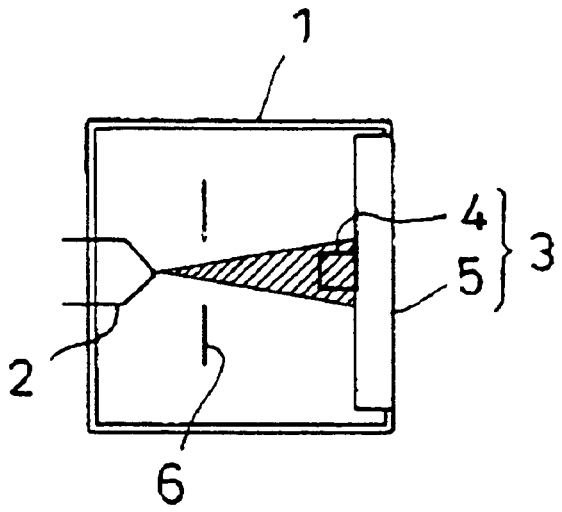
FIG. 1 is a schematic view of an X-ray generator in the first embodiment of this invention.

FIG. 1 shows a schematic view of an X-ray generator of the first preferred embodiment of the present invention. An X-ray generator has a tube body 1, made of stainless and so on, which keeps its inside in a vacuum state. The body 1 has an electron source 2 and a target member 3 therein. The target member 3 has a base member 5 and a metal target 4. The base member 5 is attached to the body 1.

The body 1 has an electrode 6 therein. The electrode 2 pulls electrons as an electron beam out of the electron source 2. The electron beam is irradiated over the metal target so that the metal target 4 generates X rays.

The target 4 is patterned into a microscopic size, for example a square with sides of 1 $\mu$m in length, on the base member 5 by chemical vapor deposition (CVD), Vacuum Evaporating Coating, and so on. The patterning is performed by a masking process.

Figure 2:
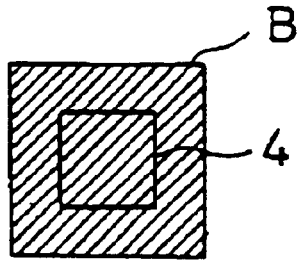
FIG. 2 is a schematic view for explaining a way of irradiating an electron beam onto a metal target.

An electron beam B, from the electron source 2, whose cross section is the shape of a square with sides of 2 $\mu$m in length at the irradiation surface of the metal target 4, is irradiated over the entire irradiation surface of the metal target 4, as shown in FIG. 1 and FIG. 2. This embodiment makes it possible to obtain a small X-ray focal point regardless of the size of the electron beam B.

Material of the base member 5 may be Aluminum, Magnesium, an alloy of Aluminum and Magnesium, Titanium, for example. Material of the metal target 4 may be Copper, Tungsten, Molybdenum, Rhenium, Thorium, an alloy of Tungsten and Rhenium, an alloy of Molybdenum and Rhenium, an alloy of Tungsten and Molybdenum, and an alloy of Tungsten, Molybdenum, and Rhenium, for example.

Figure 3:
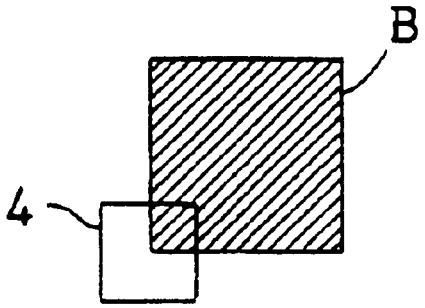
FIG. 3 is a schematic view for explaining of another way of irradiating an electron beam onto a metal target.

FIG. 3 is a schematic view for explaining another way of irradiating an electron beam onto a metal target. In this embodiment, the electron source 2 and the metal target 4 are disposed so that the electron beam B out of the electron source 2 is irradiated onto a part of the irradiation surface of the metal target 4. Therefore, a much smaller X-ray focal point is created in this embodiment.

Figure 4:
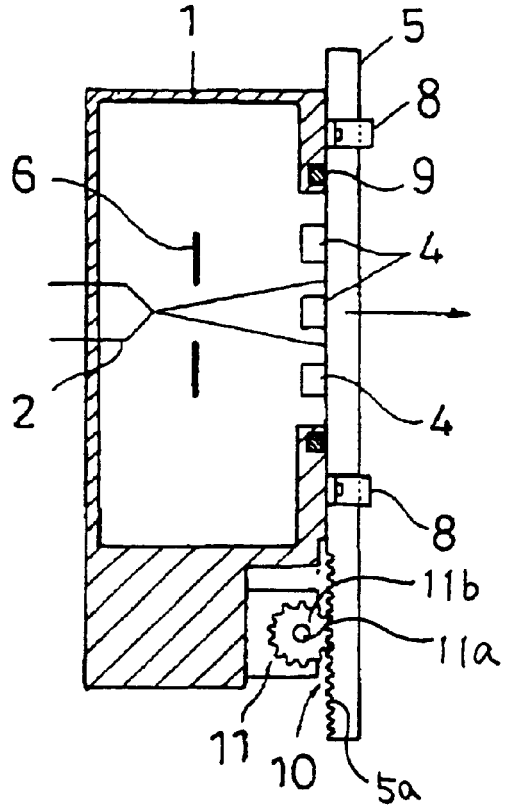
FIG. 4 is a schematic view of an X-ray generator in the second embodiment of the second invention.

FIG. 4 is a schematic view of an X-ray generator according to a second embodiment of this invention. In this embodiment, three metal targets 4 are patterned on the base member 5 to be in-line at a certain interval and also to be microscopic in size. The base member 5 is structured to be movable to the body 1, through a guide rail 8 and an O-ring 9 for sealing, in the direction along the arrangement of the targets 4.

The base member 5 has a rack gear 5a at the end part thereof. An electric motor 11, attached to the body 1 and rotating in the forward and reverse directions, has a drive shaft 11*a* and a pinion gear 11*b*. The rack gear 5*a* and pinion gear 11*b* form a rack and pinion structure 10. The base member 5 is driven to move by the electric motor 11 through the rack and pinion structure 10. Moving the base member 5 by the electric motor 11 makes it possible to select one of the metal targets 4 for irradiation of an electron beam.

Materials of the metal targets 4 are different from each other. For example, the metal targets 4 are made of Copper, Tungsten, and Molybdenum, X-ray characteristics of which are different. Therefore, the energy subtraction analysis can be carried out in which low energy X-rays, which have different characteristic X rays, are irradiated onto a cell and so on and then differences of X-ray absorptance are analyzed.

In this second embodiment, the size of each metal target 4 may be different to change the size of the X-ray focal point. On the other hand, both the size and the material of each of the targets 4 may be the same.

The remaining structures of this second embodiments are the same as those of the first embodiment, the labels of which remain the same. Explanation of these structures is therefore omitted.

Figure 5:
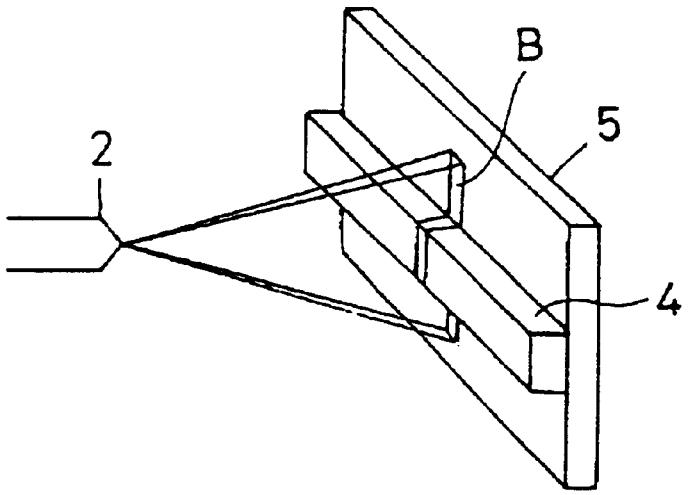
FIG. 5 is a perspective view of the main part of an X-ray generator in the third embodiment of this invention.

FIG. 5 is a perspective view of the main part of an X-ray generator according to a third embodiment of this invention. The structures different from the second embodiment are as follows. The metal target 4, which has an elongated shape and a microscopic size in width, is patterned on the base member 5. The base member 5 is structured to move in the longitudinal direction of the metal target 4, as shown in the second embodiment, not shown in FIG. 5.

In FIG. 5, the electron source 2 irradiates the electron beam B of an elongated shape which expands to cross the metal target 4 at right angles, or across the width of the metal target 4.

The remaining structures of this third embodiment are the same as those of the second embodiment, the explanation of which is therefore omitted.

Figure 6:
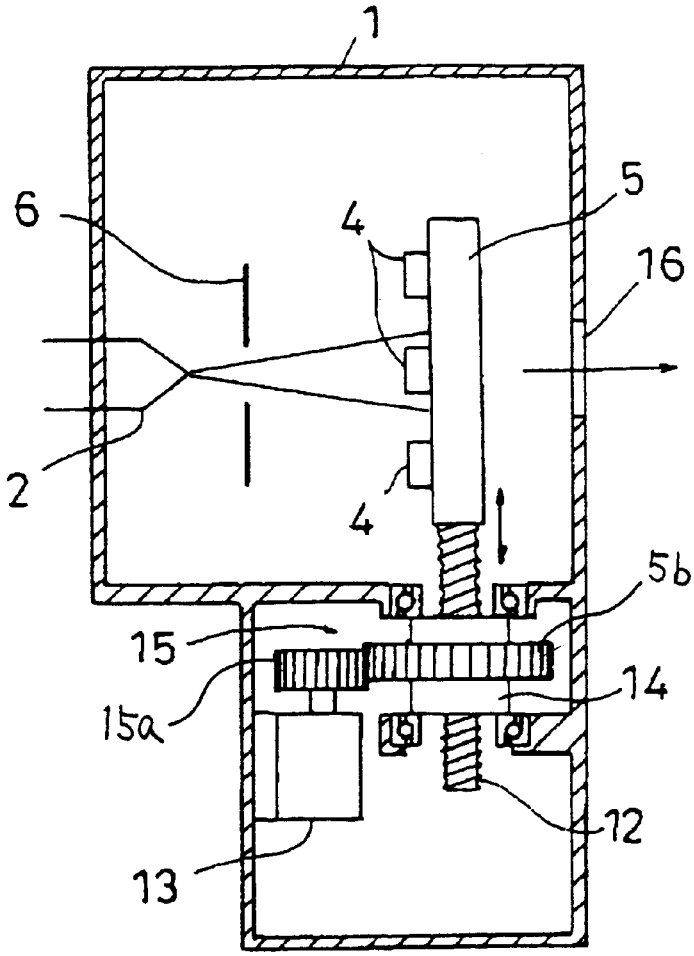
FIG. 6 is a schematic view of an X-ray generator in the fourth embodiment of this invention.

FIG. 6 is a schematic view of an X-ray generator according to a fourth embodiment of this invention. The structures different from the second embodiment are as follows. The base member 5 has a gear shaft 12 at one end thereof. The base member 5 is structured to move straight in the length direction of the elongated metal targets 4 in the body.

An electric motor 13 is attached to the body 1 and is capable of rotating in the forward and reverse directions. The electric motor is a drive gear 15*a*. A revolving body 14 with an inside screw which engages with the screw shaft 12 has a driven gear 5*b*. The drive gear 15*a* and driven gear 5*b* form a gearing 15. The electric motor 13 drives to move the base member 5 straight through the gearing 15. Adjusting the amount of movement of the base member 5 makes it possible to change each of the metal targets 4 which is irradiated by the electron beam from the electron source 2. The base member 5 has guide members, not shown in the Figures, to move it straight in the specified direction without rotation.

The body 1 has a window 16 of which X-rays are output. The window 16 is made of Aluminum and Beryllium. The other parts of the body 1 are made of stainless steel. The remaining structure of the second, third and fourth embodiment not specifically described above are the same as those of the first embodiment. Therefore, the explanation of these structures is omitted.

In the second, third, and fourth embodiments, the described structure for moving the base member 5 is only exemplary and may be other various structures. The metal targets 4 may be formed on the base member 5 lengthwise and widthwise at certain intervals. A plurality of the metal targets 4 which have an elongated shape may be also formed on the base member 5. In this case, the base member 5 may be moved in two dimensions by an X-Y table.

The base member 5 may be formed in the circular shape. In this case, the metal targets 4 may be formed on the inner or outer periphery of the base member 5 in the circumferential direction of the base member 5 (e.g., as rings or parts of rings). The base member 5 may be rotated at the center thereof.

In the second, third, and fourth embodiments, the base member 5 is structured to move to change each of the metal targets 4. However, this invention may be a structure which changes a position for irradiation of an electron beam by moving the electron source 2.

Figure 7:
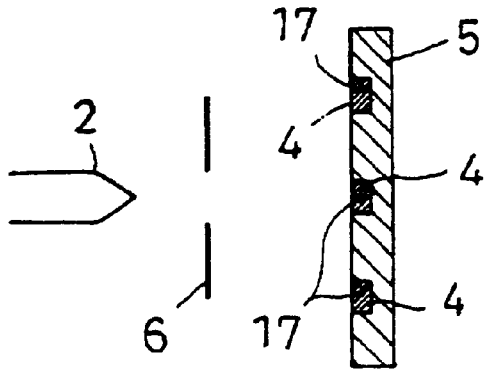
FIG. 7 is a schematic view of an X-ray generator in the fifth embodiment of this invention.

FIG. 7 is a cross section of the main part of an X-ray generator according to a fifth embodiment of this invention. The structures different from the second embodiment are as follows. The metal targets 4 are embedded into holes 17 formed in the base member 5 so that the surface of the metal targets 4 and the surface of the base member 5 facing the electron source 2, are flush or almost flush. Since the remaining structures are the same as those of the second embodiment, the explanation of these structures is omitted.

Figure 8:
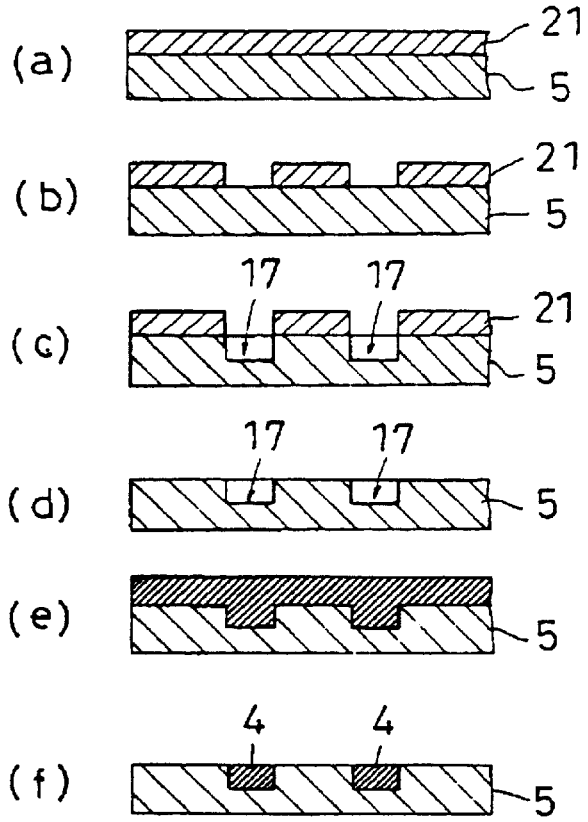
FIG. 8 is a cross section of the main part for explaining a process of making a target member of an X-ray generator in the fifth embodiment of this invention.
Figure 9:
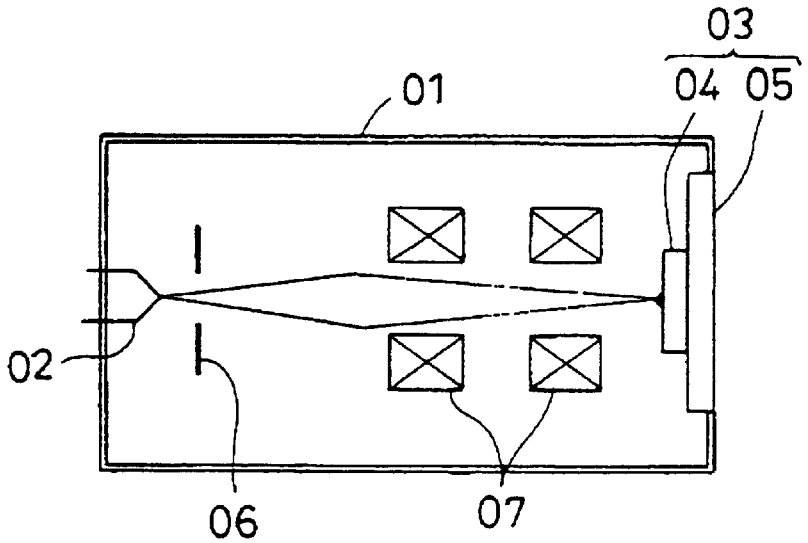
FIG. 9 is a schematic view of a related X-ray generator.

The following is a description of a process of producing a target member in the above mentioned fifth embodiment, with reference of FIG. 8. First, resist 21 is coated over the base member 5 made of Aluminum (FIG. 8 (*a*)). Then, the resist 21 is exposed in accordance with the pattern which specifies positions of the holes 17, and then a part of the resist 4, corresponding to the holes 17 for the metal targets 4, is exfoliated (FIG. 8 (*b*)). The holes 17 for the metal targets 4 are formed by etching the base member 5 (FIG. 8 (*c*)), and then the resist 4 on the base member 5 is removed (FIG. 8 (*d*)).

The material for the metal targets 4, such as Copper, Tungsten, and Molybdenum, is cumulated in the holes 17 and also on the base member 5 by CVD or Vacuum Evaporating Coating (FIG. 8 (*e*)). Afterward, the material for the metal targets 4 and the base member 5 are ground so that the metal targets 4 are exposed and also the surface of the metal targets 4 and the surface of one the base member 5 facing electron source 2 are flush or almost flush (FIG. 8 (*f*)). Through the above procedures, the metal targets 4 of metal thin film are pattered into microscopic size and then the target member in the fifth embodiment is obtained.

According to the above mentioned fifth embodiment, it is possible to make the end part of the outer periphery, facing the electron beam, of the metal targets 4 perpendicular to the electron beam. It is also possible to obtain uniform thickness of the metal targets 4 easily and obtain smaller metal targets 4.

Previously, when a thin film is formed on the surface of the base member 5 by CVD or Vacuum Evaporating Coating, the end parts of the outer peripheries, facing the electron beam, of the metal targets 4 would develop rounded edges, and the part of the metal targets 4 which have uniform thickness would therefore decrease. Thus, it was difficult if not impossible to make the metal target 4 with uniform thinness microscopic. This embodiment makes it possible to form microscopic metal targets 4 while avoiding rounding of the edges of the end parts of the outer peripheries of the metal targets 4.

Figure 10:
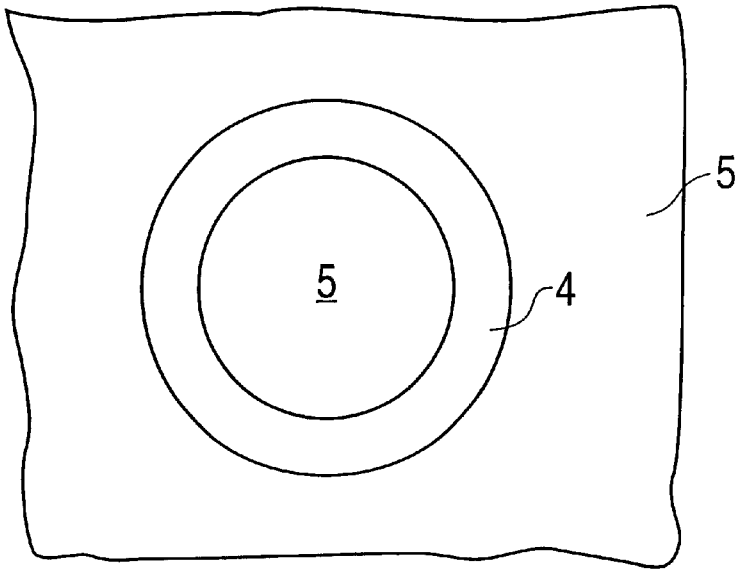
FIG. 10 is a schematic view illustrating a ring-shaped metal target.
Figure 11:
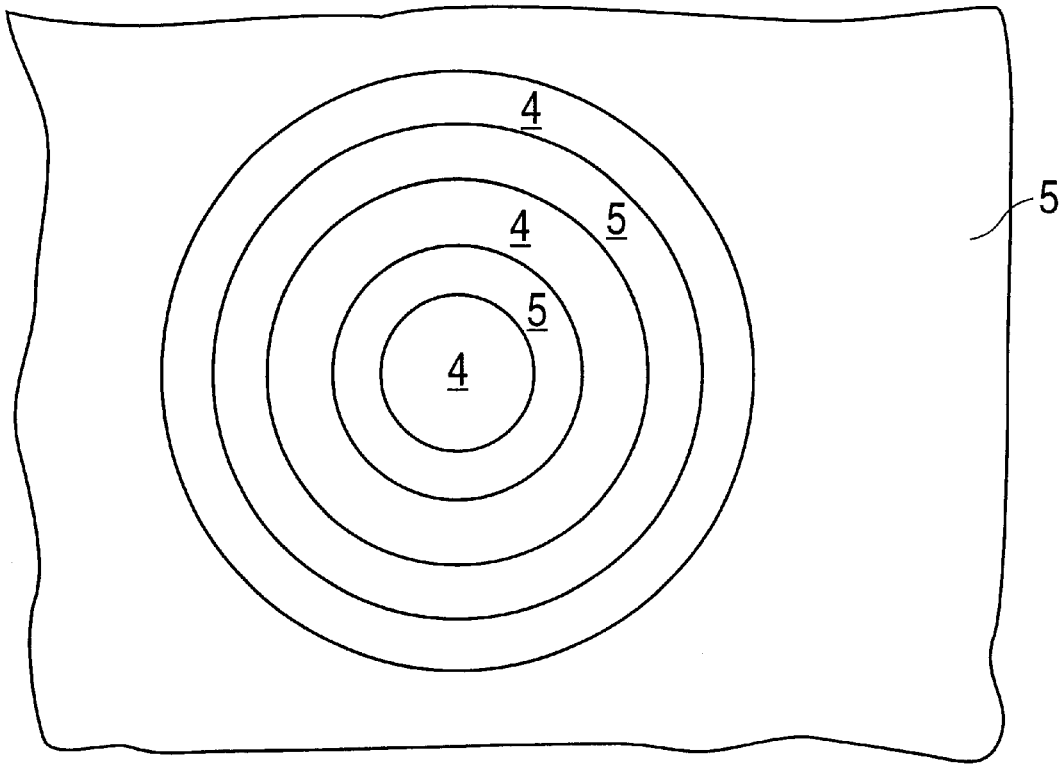
FIG. 11 is a schematic view illustrating a plurality of metal targets disposed concentrically relative to each other.

Also, the metal target 4 may be shaped in other configuration such as those shown in FIGS. 10 and 11. In FIG. 10, the metal target 4 is ring-shaped. In FIG. 11, a plurality of metal targets 4 are disposed concentrically relative to each other.

Furthermore, since the contact area of the metal targets 4 and the base member 5 can be large, it is possible to easily transmit heat, which is generated in the connection with irradiation of the electron beam from the electron source 2, into the base member 5. Therefore, it is possible to make the life of the targets 4 long by suppressing the temperature rise of the metal targets 4

In case the metal targets 4 have a projection facing an electron beam, since an electric field in connection with irradiation of an electron beam concentrates at the corners of the projection of the metal target 4, it disrupts the even irradiation of the electron beam onto the metal targets 4. In this embodiment, since the metal target 4 does not has a projection facing an electron beam, and therefore an electric field does not concentrate at one part of the metal target 4, it is possible to make the life of the metal target 4 long.

According to this invention, since an X-ray focal point can be small regardless of the size of an electron beam from an electron source, it is possible to obtain a small X-ray focal point easily without an electric lens. When an electric lens is used, it is possible to adapt a simple electric lens as well as a cooling system for it. Therefore, a low-cost and compact X-ray generator can be obtained which has a small focal point.

When a plurality of different metal targets are used, it is possible to generate different characteristic X rays and also change the size of the X-ray focal point, in accordance with objects on which X-ray is irradiated, by moving the metal targets and the electron source relatively. Therefore, X-rays suitable to the objects can be generated, and general purpose use for an X-ray generators can be expanded.

In case a plurality of the same metal targets are used, when performance of one metal target in use decreases due to consumption and so on, it is possible to generate an X-ray without discontinuance just by changing the exhausted metal target for another target.

It is possible to make an X-ray focal point much smaller by irradiating an electron beam onto only a part of small metal target. Therefore, it is possible to improve resolution of objects to expand general purpose use for X-ray generators because an X-ray can be irradiated onto small objects.

Since the contact area of the metal targets and the base member can be large, it is possible to easily transmit heat, which is generated in the connection with irradiation of the electron beam from the electron source, into the base member. Therefore, it is possible to make the life of the target long by suppressing the temperature rise of the metal targets. It is therefore possible to reduce the frequency of changing a metal target, thus making it easy to maintain the X-ray generator.

It is possible to make the end part of the outer periphery, facing the electron beam, of the metal targets perpendicular to the electron beam, by making the surface of the metal targets and the surface of the base member facing electron source flush or almost flush. Therefore, it is also possible to obtain a uniform thickness of the metal targets easily and to obtain smaller metal targets.

The metal target need not have a projection facing the electron beam and therefore electric field does not concentrate at one part of the electron target. It is therefore possible to make the life of the metal target long.

What is claimed is:

1. An X-ray generator comprising:

a vacuum tube body, an inside of the vacuum which is maintainable in a vacuum state;

an electron source, generating an electron beam within the vacuum tube body; and a microscopic metal target, positioned within the vacuum tube body, to intercept at least part of the electron beam, so that said electron source irradiates said electron beam onto said metal target to generate X-rays by irradiation of said electron beam, wherein said metal target is a metal film which is patterned.

2. An X-ray generator according to the claim 1, further comprising:

an electrode pulling said electron beam out of said electron source.

3. An X-ray generator according to the claim 1, wherein said metal target is made of one of Copper, Tungsten, Molybdenum, Rhenium, Thorium, an alloy of Tungsten and Rhenium, an alloy of Molybdenum and Rhenium, an alloy of Tungsten and Molybdenum, and an alloy of Tungsten, Molybdenum, and Rhenium.

4. An X-ray generator according to claim 1, wherein said metal target comprises one of a chemical vapor deposition coating and a vacuum evaporating coating.

5. An X-ray generator comprising:

a vacuum tube body, an inside of which is maintainable in a vacuum state;

an electron source, attached to said inside, generating an electron beam;

plurality of microscopic metal targets, positioned within the vacuum tube body to intercept at least part of the electron beam, so that said electron source irradiates said electron beam onto said metal targets to generate X-rays by irradiation of said electron beam, wherein said metal targets are metal films which are patterned; and a driver relatively moving said metal targets and said electron beam to change one of said metal targets for another one for irradiation of said electron beam.

6. An X-ray generator according to claim 5, wherein said metal targets are elongated.

7. An X-ray generator according to claim 5, further comprising:

a base member on which said metal targets are formed, wherein said driver is a motor with a pinion gear, and wherein a rack gear which engages with said pinion gear is formed at an end part of said base member, whereby rotation of said motor causes movement of said base member.

8. An X-ray generator according to claim 4, wherein the composition of at least two of said metal targets are different.

9. An X-ray generator according to claim 5, wherein the size of at least two of said metal targets are different.

10. An X-ray generator according to claim 5, wherein said metal targets are made of the same material and said metal targets have the same size.

11. An X-ray generator according to claim 1, wherein said metal target has an elongated shape.

12. An X-ray generator according to claim 11, wherein said electron source irradiates the electron beam having an elongated shape, and wherein said electron source irradiates the electron beam having an elongated shape, and wherein the lengths of the electron beam and the metal target cross at right angles.

13. An X-ray generator according to claim 5, wherein said tube body has a window through which X-rays are output.

14. An X-ray generator according to claim 13, wherein said window is made of Aluminum or Beryllium.

15. An X-ray generator according to claim 5, wherein said metal targets are ring-shaped.

16. An X-ray generator according to claim 15, wherein said metal targets are placed concentrically.

17. An X-ray generator according to claim 5, further comprising:

a base member, wherein said metal targets are embedded in said base member.

18. An X-ray generator according to claim 17, wherein the surface of said metal targets and a surface of said base member facing said electron source are substantially flush.

19. A method for preparing a microscopic metal target for irradiation by an electron beam, comprising:

coating a resist on a base member;

exposing said resist in accordance with a pattern which specifies a position of at least one hole for at least one microscopic metal target;

exfoliating parts of said resist, corresponding to the hole for said metal target;

etching said base member to form said hole for said metal target;

removing said resist on said base member; and cumulating a metal material in the hole to thereby form the metal target.

20. A method for preparing a metal target according to claim 19, further comprising:

grinding said metal material for the metal target and said base member so that said metal target is exposed and a surface of the metal target and a surface of said base member facing are substantially flush.

21. The method of claim 19 wherein a plurality of metal targets are formed in a plurality of corresponding holes.

22. An X-ray generator according to claim 1, wherein said metal target has a uniform thickness produced by a masking process.

23. An X-ray generator according to claim 5, wherein said plurality of metal targets have a uniform thickness produced by a masking process.

* * * * *